US009383702B2

(12) United States Patent
Kubota

(10) Patent No.: US 9,383,702 B2
(45) Date of Patent: Jul. 5, 2016

(54) IMAGE FORMING APPARATUS AND IMAGE FORMING METHOD FOR SETTING IMAGE FORMING SIZE

(71) Applicant: Sharp Kabushiki Kaisha, Osaka-shi, Osaka (JP)

(72) Inventor: Kazuhisa Kubota, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/462,608

(22) Filed: Aug. 19, 2014

(65) Prior Publication Data

US 2015/0071672 A1 Mar. 12, 2015

(30) Foreign Application Priority Data

Sep. 9, 2013 (JP) ..... 2013-185839

(51) Int. Cl.
*G03G 15/00* (2006.01)

(52) U.S. Cl.
CPC ..... *G03G 15/5016* (2013.01); *G03G 15/502* (2013.01); *G03G 15/5095* (2013.01); *G03G 15/607* (2013.01); *G03G 15/6508* (2013.01); *G03G 15/6594* (2013.01); *G03G 2215/00232* (2013.01); *G03G 2215/00464* (2013.01)

(58) Field of Classification Search
CPC ..... G03G 15/5025; G03G 15/5029; G03G 15/5095; G03G 15/607; G03G 15/6508
USPC ..... 399/45, 81, 370, 376, 389
See application file for complete search history.

(56) References Cited

U.S. PATENT DOCUMENTS

| | | | | |
|---|---|---|---|---|
| 6,285,842 | B1 * | 9/2001 | Katamoto et al. | 399/81 |
| 8,392,833 | B2 * | 3/2013 | Yamaguchi et al. | 715/274 |
| 8,711,392 | B2 * | 4/2014 | Inoue | 358/1.15 |
| 2008/0256476 | A1 * | 10/2008 | Seo et al. | 715/772 |
| 2014/0036279 | A1 * | 2/2014 | Tohki et al. | 358/1.2 |

FOREIGN PATENT DOCUMENTS

| | | | |
|---|---|---|---|
| JP | 61282859 | A * | 12/1986 |
| JP | 02191935 | A * | 7/1990 |
| JP | 2000-039980 | A | 2/2000 |
| JP | 2006072224 | A * | 3/2006 |
| JP | 2007074540 | A * | 3/2007 |
| JP | 2007133676 | A * | 5/2007 |
| JP | 2010-87855 | A | 4/2010 |
| JP | 2011151570 | A * | 8/2011 |
| JP | 2012-68999 | A | 4/2012 |

* cited by examiner

*Primary Examiner* — Robert Beatty
(74) *Attorney, Agent, or Firm* — Keating & Bennett, LLP

(57) ABSTRACT

An image forming apparatus includes an operating section, a control section and an image display unit. The operating section accepts inputting operations for settings on information on an image forming size of an original image and a setting on a paper sheet size. The control section compares the image forming size with the paper sheet size, and outputs, if the image forming size exceeds the paper sheet size at least in either of a lengthwise direction and a lateral direction, a notice signal to cause a notice to that effect. The image display unit displays a preview image based on the notice signal.

6 Claims, 4 Drawing Sheets

IMAGE FORMING APPARATUS AND IMAGE FORMING METHOD FOR SETTING IMAGE FORMING SIZE

CROSS REFERENCE

This Nonprovisional application claims priority under 35 U.S.C. §119(a) on Patent Application No. 2013-185839 filed in Japan on Sep. 9, 2013, the entire contents of which are hereby incorporated by reference.

BACKGROUND OF THE INVENTION

The present invention relates to an image forming apparatus such as copier, printer, facsimile equipment, multifunctional apparatus thereof or the like, and to an image forming method.

Among image forming apparatus for forming an image onto a paper sheet based on image data is there one that is configured in such a manner as to accept settings on image forming conditions such as image forming range, scale factor, concentration and so forth for an image to be formed and to display a preview image that shows a consequence of an image forming corresponding to the settings on the image forming conditions before the image forming is performed onto a paper sheet (for example, refer to Japanese Patent Unexamined Publication No. 2000-39980 bulletin).

However, in the above-mentioned conventional image forming apparatus, although it is possible to examine a consequence of an image itself that has been changed corresponds to a change of the image forming conditions, it is not possible to choose whether to display a preview image or not depending on the image forming conditions; so that it can occur that the preview image is displayed even when unnecessary and not displayed even when necessary. Nor is it possible even to examine an image forming size as compared to a paper sheet size. For instance, when an original image size is larger than a paper sheet size, or when even though an original image size is not larger than a paper sheet size it is enlarged due to a change of the settings on the image forming conditions that is made by a user, it can occur that the image extends beyond the paper sheet. Consequently, failing to obtain an image as intended, the user is left with no alternative but to do again a series of tasks for an image forming. This results in a waste of money and time.

The present invention is directed to providing an image forming apparatus and an image forming method capable of suppressing a waste of money and time.

SUMMARY OF THE INVENTION

An image forming apparatus of the present invention includes a first operating section, a second operating section, a control section and a notice section. The first operating section accepts an inputting operation for a setting on information on an image forming size of an original image. The second operating section accepts an inputting operation for a setting on a paper sheet size. The control section compares the set image forming size with the set paper sheet size and outputs, if the image forming size exceeds the paper sheet size at least in either of a lengthwise direction and a lateral direction, a notice signal to cause a notice to that effect. The notice section serves the notice to a user based on the notice signal.

With this configuration, since if the set image forming size exceeds the set paper sheet size the notice to that effect is served by the notice section, an image forming that is not intended by a user is suppressed, regardless of levels of functional knowledge and/or operational skill of the user on the image forming apparatus. Thus, the invention makes it possible to suppress a waste of money and time.

An image forming method of the present invention sequentially performs the following steps: a first operation step of accepting an inputting operation for a setting on information on an image forming size of an original image; a second operation step of accepting an inputting operation for a setting on a paper sheet size; a control step of comparing the set image forming size with the set paper sheet size and outputting, if the image forming size exceeds the paper sheet size at least in either of a lengthwise direction and a lateral direction, a notice signal to cause a notice to that effect; and a notice step of serving the notice to a user based on the notice signal.

With this configuration, since if the set image forming size exceeds the set paper sheet size the notice to that effect is served by the notice section, an image forming that is not intended by a user is suppressed, regardless of levels of functional knowledge and/or operational skill of the user on the image forming apparatus. Thus, the invention makes it possible to suppress a waste of money and time.

DETAILED DESCRIPTION OF THE INVENTION

First Embodiment

Figure 1:
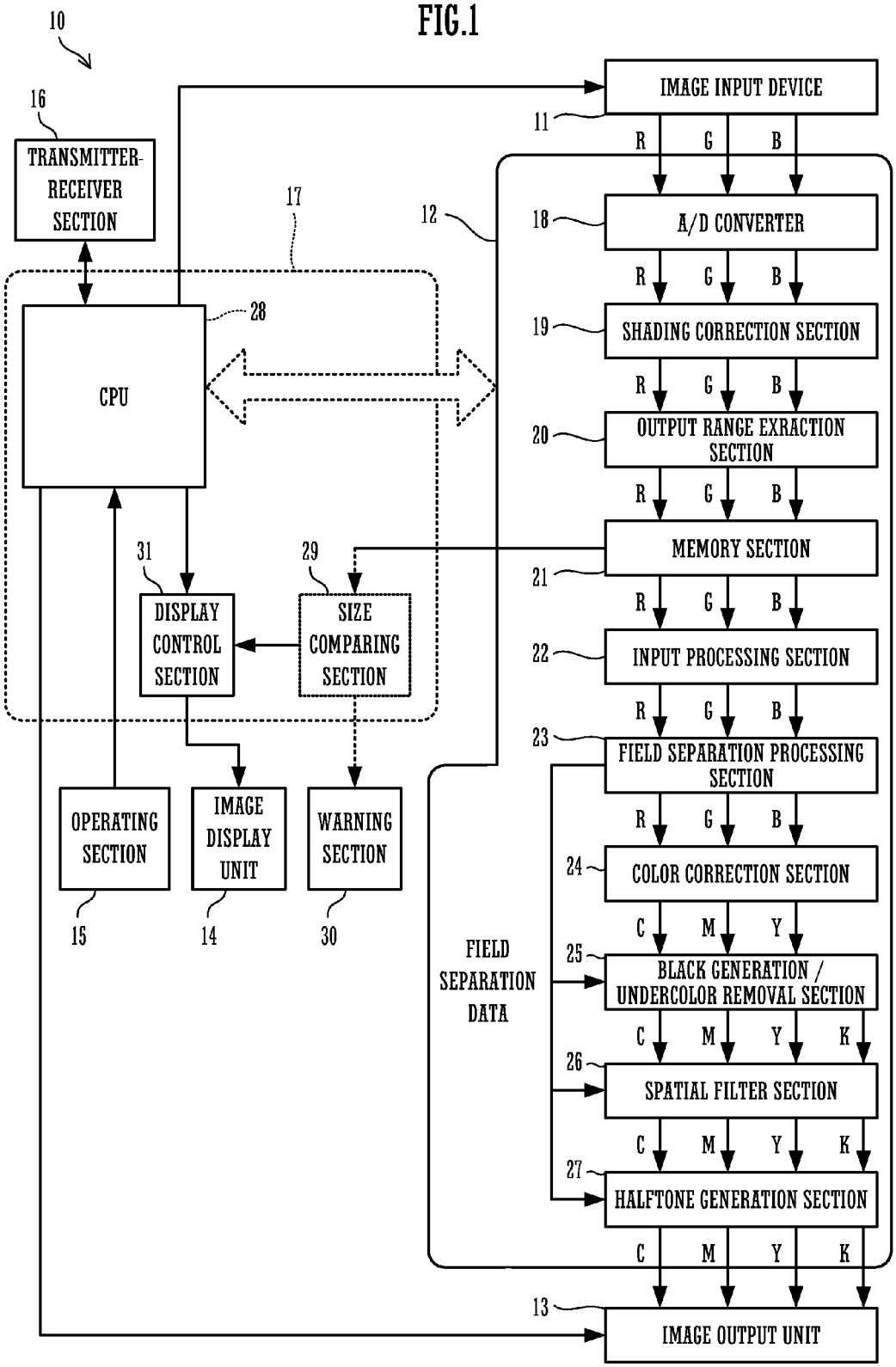
FIG. 1 is a block diagram showing a general configuration of an image forming apparatus according to an embodiment of the present invention.

As shown in FIG. 1, an image forming apparatus 10 according to a first embodiment of the present invention includes an image input device 11, an image processing system 12, an image output unit 13, an image display unit 14, an operating section 15, a transmitter-receiver section 16, a control section 17, and a warning section 30.

The image input device 11 is a scanner, and has a line sensor, for example. The image input device 11 optically reads an image of a document, and therefrom producing image data consisting of electric signals for a color that is separated into R (red), G (green) and B (blue), outputs the image data to the image processing system 12.

The transmitter-receiver section 16 carries out transmission and reception of the image data through a network. The transmitter-receiver section 16 outputs the image data received from outside to the image processing system 12. The transmitter-receiver section 16 also transmits image data inputted from the image processing system 12 to outside.

The image processing system 12 has an analog-digital conversion section (hereinafter referred to as A/D converter) 18, a shading correction section 19, an output range extraction section 20, a memory section 21, an input processing section 22, a field separation processing section 23, a color correction section 24, a black generation/undercolor removal section 25, a spatial filter section 26, and a halftone generation section 27.

The A/D converter 18 converts analog RGB signals inputted from the image input device 11 into digital signals.

The shading correction section 19 removes varieties of distortions that occur in an illumination system, an image formation system and an image pickup system of the image input device 11 and are included in the image data in the digital signals.

In a case where an image forming range is specified in the image data, the output range extraction section 20 extracts image data for the specified range.

The memory section 21 is one that stores image data, and also capable of storing the image data in the digital signal inputted from the transmitter-receiver section 16, apart from the image data inputted from the output range extraction section 20. The memory section 21 can also send the image data to a next process.

The input processing section 22 performs a gamma (γ) correction to the image data output from the memory section 21. Here, in the following description, an image of image data consisting of R, G and B is referred to as an RGB image; while an image of image data consisting of C (cyan), M (magenta) and Y (yellow) is referred to as a CMY image. Likewise, an image of image data consisting of C, M, Y and K (black) is referred to as a CMYK image.

The field separation processing section 23 determines which field each picture element of an RGB image belongs to among a plurality of kinds of fields such as black letters, color letters, halftone dots, photographic paper photography (continuous tone field) and so forth. Also, the field separation processing section 23 outputs results of the determination, as field separation data that indicate respective kinds of their fields to which the respective picture elements belong, to the black generation/undercolor removal section 25, the spatial filter section 26, and the halftone generation section 27. In the respective sections to which the field separation data are inputted, processes corresponding to the kinds of the fields are carried out.

The color correction section 24 performs a color space conversion from an RGB image into a CMY image, and further carries out a process to improve color reproduction quality.

The black generation/undercolor removal section 25 converts the CMY image that can be expressed with toners of three colors into a CMYK image that is expressed with toners of four colors.

The spatial filter section 26 carries out a highlighting process and a smoothing process to the CMYK image.

The halftone generation section 27 carries out a tone reproducing process in order for the CMYK image to be output for an image forming.

In this manner, the image processing system 12 processes the image data inputted from the image input device 11 or the image data that is received by the transmitter-receiver section and stored in the memory section 21, and outputs the processed image data to the image output unit 13 or the image display unit 14.

The image output unit 13 has a printer function, and performs an image forming onto a paper sheet based on the image data processed by the image processing system 12. For the paper sheet, recording medium such as normal paper, thick paper, OHP film or the like can be exemplified. As an example of the image output unit 13, a printer according to the electrophotography method or a printer according to the ink jet printing method can be given.

The operating section 15 accepts inputting operations for settings on information on an image forming size of an original image and a setting on a paper sheet size, along with inputting operations for settings on other image forming conditions, for an order to start an image forming and so forth. For the information on an image forming size of an original image, an image forming range indicating a range of an image of which image is to be formed among the image data, a scale factor indicating a ratio of the size of the image that is to be formed actually onto the paper sheet to a size of an original image, and a rotational angle can be given. As an example, the operating section 15 includes an LCD touch panel.

The control section 17 has a CPU 28, and exercises general control over each section of the image forming apparatus 10. Apart from the CPU 28, the control section 17 has a size comparing section 29 and a display control section 31. The size comparing section 29 compares a set image forming size with a set sheet size. As an example, when an image forming range is specified and a scale factor is set, an image forming size, which is acquired from a product value of an image size of the specified range that is extracted by the output range extraction section 20 and the scale factor, is compared with a paper sheet size. If the image forming size exceeds the paper sheet size at least in either of a lengthwise direction and a lateral direction of the image, the size comparing section 29 outputs a notice signal to cause a notice to that effect to the warning section 30 and the display control section 31.

The warning section 30 emits a beep to alert an operator based on the above-mentioned notice signal.

The display control section 31 produces a page to be displayed on the image display unit 14, and controls displaying operation of the image display unit 14. For examples of the information on the page produced by the display control section 31, status of a process being performed by the image processing system 12, information on settings for the process, and information to alert the operator can be given. The information to alert the operator is produced when the above-mentioned notice signal is inputted from the size comparing section 29. If the above-mentioned notice signal is inputted from the size comparing section 29, a page is produced that displays information to notify the operator to the effect that the image forming size exceeds the paper sheet size at least in either of the lengthwise direction and the lateral direction of the image. For examples of the information to alert the operator when the above-mentioned notice signal is inputted from the size comparing section 29, a message and/or an image indicating the image forming size as compared to the sheet size can be given.

Each of the warning section 30 and the display control section 31 corresponds to a notice section of the present invention.

The image display unit 14 is, for example, a LCD display installed in the operating section 15. Besides, for the image display unit 14, an organic EL (electroluminescence) display unit or the like can be given.

Figure 2:
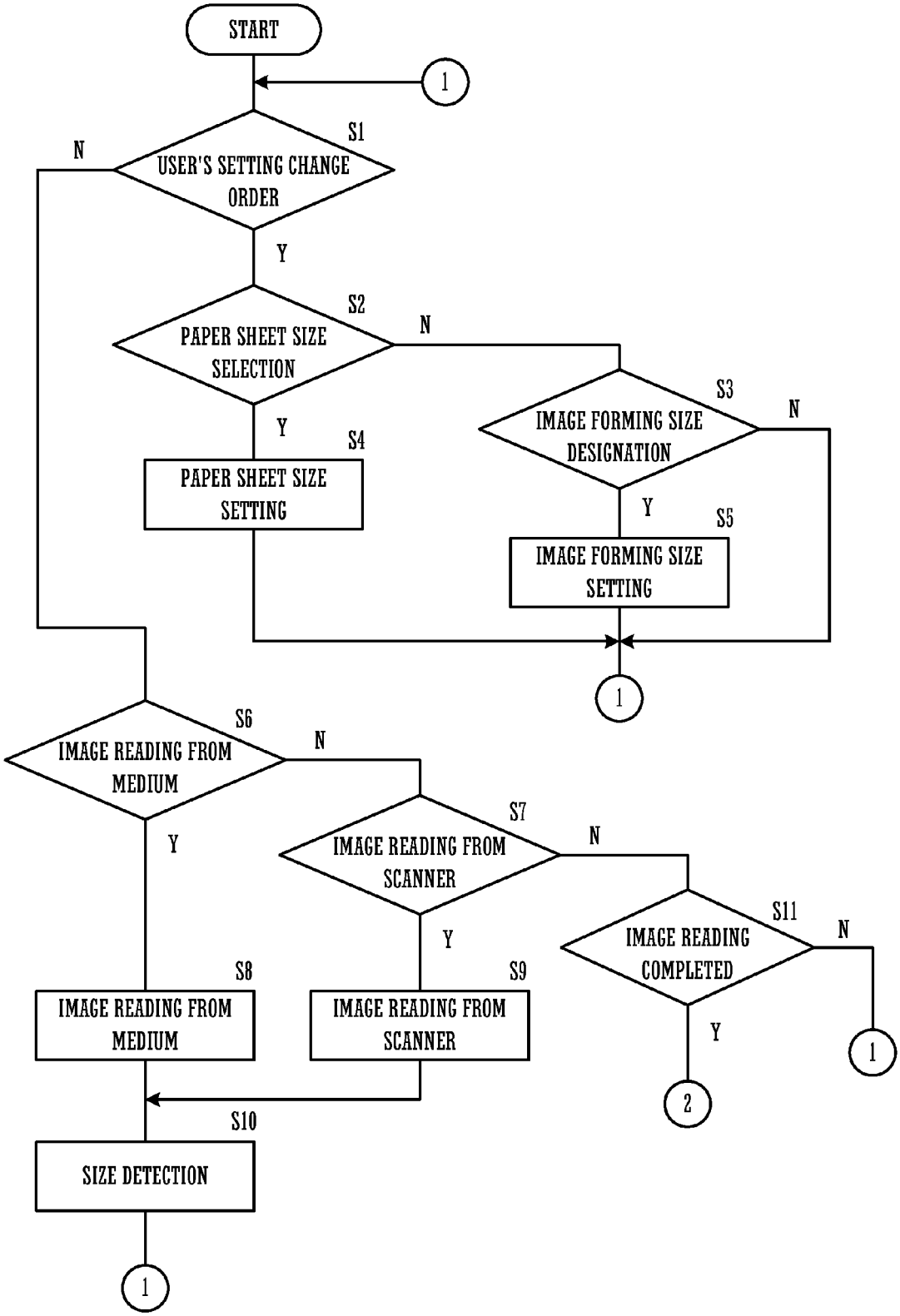
FIG. 2 is a flow chart showing a part of procedures performed by a control section.
Figure 3:
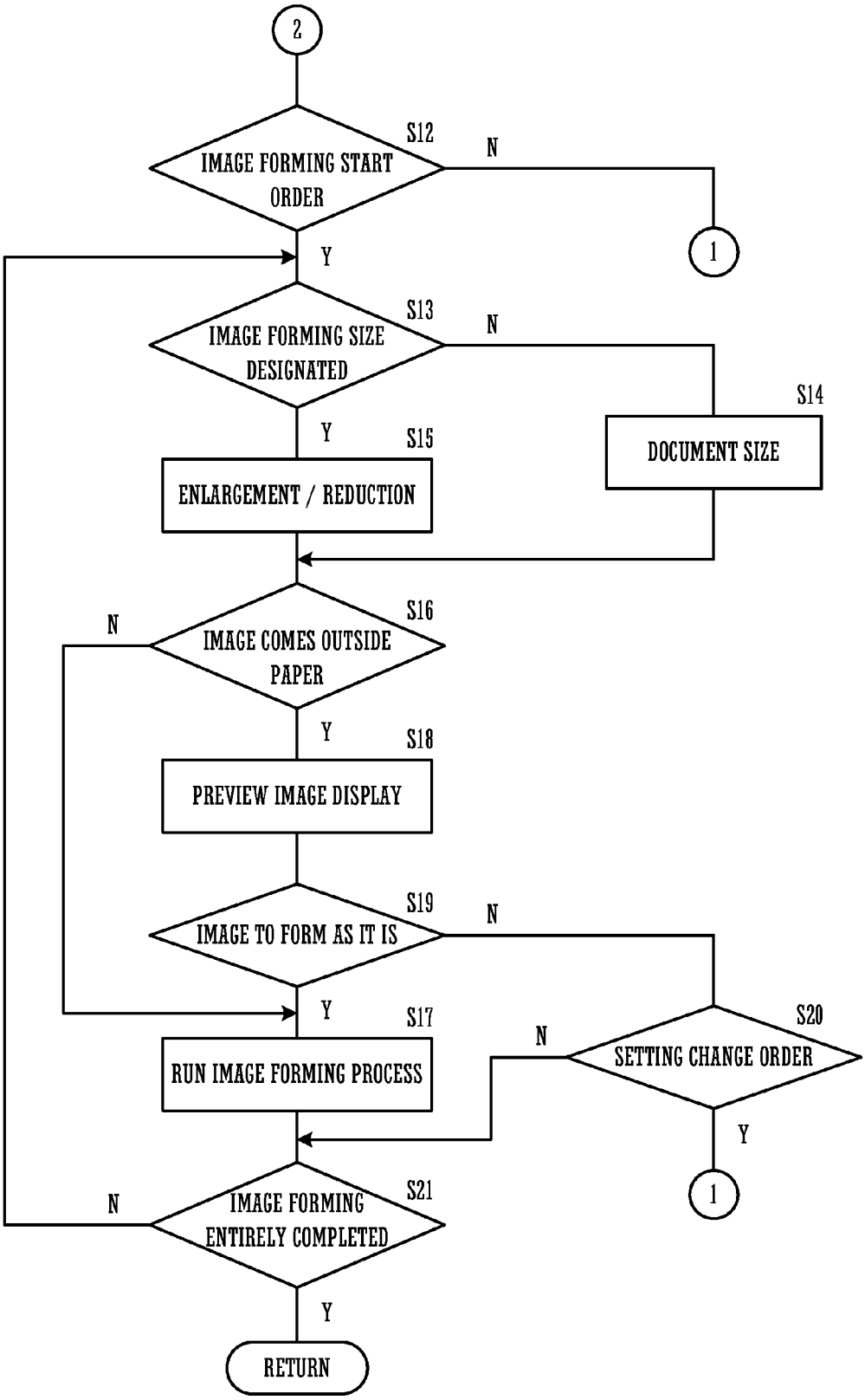
FIG. 3 is a flow chart showing another part of procedures performed by the control section.

Subsequently, referring to FIG. 2 and FIG. 3, procedures performed by the control section 17 is explained.

As default settings on the image forming conditions, for example, a predetermined size for the sheet size, a total range of the document for the image forming range, and an equal magnification (unity) for the scale factor are set beforehand. In normal situations, the operating section 15 is configured in such a manner that options on the settings on the image forming conditions and a setting on methods for acquiring the image data are selectable.

The control section 17 waits for inputting operations for the settings on the image forming conditions and the setting on methods for acquiring the image data, and upon receiving an order to change the settings on the image forming conditions from a user (S1), determines whether the order to change is a selection of the paper sheet size (S2), or designation of the information on the image forming size (S3). In this embodiment, as the information on the image forming size, inputting operations for a setting on the scale factor for enlargement or reduction and for a setting on the rotational angle are accepted.

If a paper sheet size is selected among the image forming conditions, the control section 17 sets the paper sheet size to the selected paper sheet size (S4); and if the information on the image forming size is specified among the image forming conditions, the control section 17 performs settings on the information on the specified image forming size (S5).

If an inputting operation for the setting on methods for acquiring an image data is performed rather than an order to change the settings on the image forming conditions, the control section 17 determines whether the designation is made to the effect that the image data are to be read from a storage medium such as, for example, a USB flash memory or a hard disk (S6), or whether the designation is made to the effect that the image data are to be produced by scanning an image of the document at the image input device 11 (S7), and acquires the image data by the specified method. In other words, if the designation is made to the effect that the image data are to be read from a storage medium, the control section 17 reads the image data from the specified storage medium (S8); and if the designation is made to the effect that the image data are to be produced by scanning an image of the document at the image input device 11, the control section 17 produces the image data by scanning the image of the document at the image input device 11 (S9). While reading an original image from the recording medium and/or scanning an original image at the image input device 11, the control section 17 detects an original image size (S10). Here, a document size refers to a size of a paper sheet where an original image is contained.

The control section 17 repeats processes from S1 to S10 until it acquires the image data, upon determining that the image data are acquired (S11), and thereupon assuming that minimum preparations for an image forming are ready, increases options for the order to start an image forming in the operating section 15, in addition to the options for the settings on further image forming conditions and the options for the setting on methods for acquiring the image data. If an order to start an image forming is inputted (S12), the control section 17 determines whether or not designation of the information on the image forming size for the objective image data is made (S13).

The control section 17, assuming that the whole document is the image forming range, judges a document size to be the image forming size (S14) if the scale factor is not changed, whereas sets the image forming size by multiplying the document size by the scale factor if the scale factor is changed (S15).

As to the paper sheet size, a paper sheet size of the default setting is set if the selection is not made, whereas the selected paper sheet size is set to the paper sheet onto which the image is output in S4 if the selection is made. In this first embodiment, A4 vertical format is set as the paper sheet size of the default setting.

The control section 17 compares the set image forming size with the paper sheet size that is set to the output paper sheet, and determines whether or not the image forming size exceeds the paper sheet size at least in either of the lengthwise direction and the lateral direction of the image (S16).

If the image forming size does not exceed the paper sheet size in both the lengthwise direction and the lateral direction, the control section 17 performs an image forming process without suspending the process (S17).

On the other hand, if the image forming size exceeds the paper sheet size at least in either of the lengthwise direction and the lateral direction, that is, in a case where the image will extend beyond the paper sheet if the image forming process is performed as it is, the control section 17 produces a preview image of the situation and displays the preview image on the image display unit 14 (S18), and thereby alert the user; then waits until an order is issued by the user on subsequent processes.

Figure 4A:
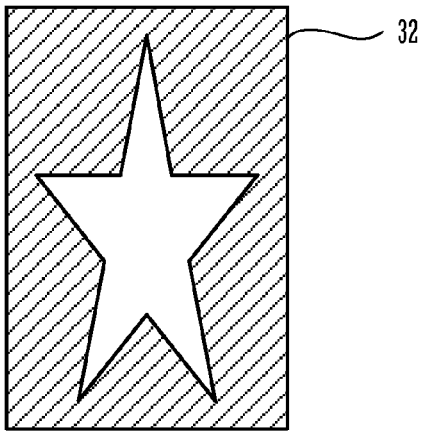
FIG. 4A is a schematic diagram illustrating an original image; with FIG. 4B being a schematic diagram illustrating an image forming size as compared to a paper sheet size.
Figure 4B:
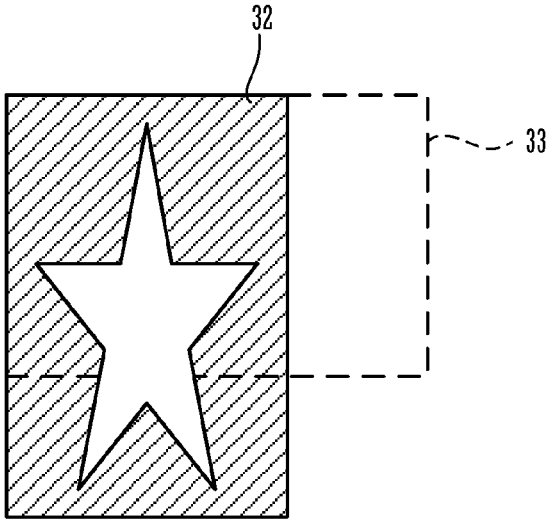
FIG. 4C being a schematic diagram illustrating an example of a display on an image display unit.
Figure 4C:
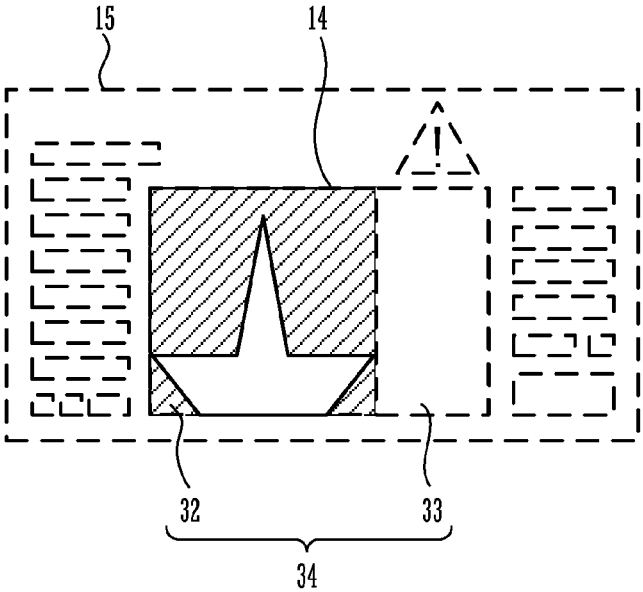

An example is shown in FIG. 4A-FIG. 4C. Whereas the size of the document 32 is A4 vertical format as shown in FIG. 4A, when the size of the selected paper sheet 33 is A4 horizontal format that is disposed along the lateral direction although the size is the same A4 as shown in FIG. 4B, a part of the document 32 will extend beyond the paper sheet if its image is formed as it is. Therefore, as shown in FIG. 4C, a preview image 34 of the paper sheet 33 of the set paper sheet size and an image of the document 32 that is to be formed onto the paper sheet 33 of the paper sheet size is displayed on the image display unit 14.

If the set image forming size exceeds the set paper sheet size, since a preview image of the situation is displayed on the image display unit 14, an image forming that is not intended by the user is suppressed, regardless of levels of functional knowledge and/or operational skill of the user on the image forming apparatus 10. Moreover, with the preview image displayed, whether or not the image extends beyond the paper sheet can be visually checked easily. Therefore, it is possible to prevent occurrences of situations such that the user, failing to obtain an image as intended, has nothing but to do again a series of tasks for an image forming, and thereby it is also possible to suppress a waste of paper sheets and toners. Thus, a waste of money and time can be suppressed.

The control section 17 waits for an input with respect to whether or not an image forming may be performed as it is in a state of the image extending beyond the paper sheet (S19), and performs an image forming process under the set conditions if an input to the effect of its affirmation is accepted. In this situation, although not illustrated, so as to ensure that the image forming size does not exceed the set paper sheet size, the control section 17 may be configured in such a manner as to display messages such as "please reduce", "please rotate the image", "please select the paper sheet again" and/or the like, together with button icons for "reduction", "rotation" and a button icon for selecting a paper sheet that is larger than the selected paper sheet that are all displayed in such a manner as to appear differently from the other button icons.

Further, if an input for a selection is made to the effect that the image forming conditions are to be reset (S20), the control section 17 returns to the process of S1, and accepts the inputting operations for resetting the image forming conditions.

By accepting the inputting operations for resetting the image forming conditions at the operating section 15 if the image forming size exceeds the paper sheet size at least in either of the lengthwise direction and the lateral direction, it is made possible to carry out the respective settings on the image forming size and the paper sheet size again when there is inconvenience in that the image will extend beyond the paper sheet as it is under the present image forming conditions. This enables the user to carry out the settings on at least either of the image forming size and the paper sheet size again, and thus an image forming that is not intended by the user can be suppressed.

If it is denied to carry out an image forming as it is in the state where the image will extend beyond the paper sheet, and it is also denied to reset the image forming conditions, the control section 17 skips an image forming process for the image data as current objective. That is, the image forming process for the image data as current objective is not carried out.

The control section 17 determines whether or not image forming processes have been completed for all the image data that have been retrieved from the storage medium or scanned with the image input device 11 (S21), and if not completed, returns to S13 and repeats the processes from S13 to S21 for next image data, and returns to the process of S1 when completed.

In this manner, in a case where a print job to carry out image forming processes for a plurality of image data one after another is executed, each image forming size is compared with each paper sheet size for each image forming process for the print job based on the information on set image forming sizes and set paper sheet sizes for a whole of the print job, and a preview image is displayed each time when the image forming size exceeds the paper sheet size.

With this configuration, since it is informed that the image forming size exceeds the paper sheet size if it happens even when a large number of image forming processes are carried out, operability improves and thus time can be saved as compared to a case where the user by oneself carries out the task of checking whether or not the image forming size exceeds the paper sheet size piece by piece. Moreover, since each preview image is displayed each time when the image forming size exceeds the paper sheet size for the respective image forming processes for the print job, it is made possible to examine details easily even with the image display unit 14 of a small size as compared to a case where preview images are displayed for all the images at a time prior to an image forming onto the paper sheet in a first image forming process for the print job.

Second Embodiment

An image forming apparatus 10 according to a second embodiment is configured in the same manner as the image forming apparatus 10 according to the first embodiment except that the total range of the original image is set to the image forming range as the default setting, that a size of an area where the image exists in the document is compared with the paper sheet size that is set to the output paper sheet, and that thereby whether or not the image forming size exceeds the paper sheet size at least in either of the lengthwise direction and the lateral direction is determined.

In the image forming apparatus 10 according to the second embodiment, as the information on the image forming size, inputting operations for the settings on the image forming range, the scale factor for enlargement or reduction and the rotational angle are accepted. Also, in S10, while reading an original image from the recording medium and/or scanning an original image at the image input device 11, the control section 17 detects an original image size. In the above, an original image size refers to a size of an area where the image exists in the document.

Upon determining that the image forming range is not specified in S13, the control section 17 assumes that the entire original image is the image forming range; and upon determining that the image forming range is specified, the control section 17 extracts the image data of the specified range. Further, if the setting is made on the scale factor, the image forming size is set by multiplying the image size by the scale factor.

The control section 17 compares the set image forming size with the paper sheet size that is set to the output paper sheet, and determines whether or not the image forming size exceeds the paper sheet size at least in either of the lengthwise direction and the lateral direction of the image (S16).

Third Embodiment

As an image forming apparatus 10 according to a third embodiment, a configuration in which a first operating section that accepts the inputting operations for the settings on the information on the image forming size of the original image and a second operating section that accepts the inputting operation for the setting on the paper sheet size are included as separate members can be considered.

It is conceivable that new embodiments may be constituted by combining respective technical special features of the above-mentioned embodiments with each other.

The above explanation of the embodiments is nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus comprising:

a first operating section that accepts an inputting operation for a setting on information on an image forming size of an original image;

a second operating section that accepts an inputting operation for a setting on a paper sheet size;

a control section that compares the set image forming size with the set paper sheet size and outputs, if the image forming size exceeds the paper sheet size at least in either of a lengthwise direction and a lateral direction, a notice signal to cause a notice to that effect; and a notice section that serves the notice to a user based on the notice signal; wherein the control section, in a case of executing a print job to carry out image forming processes for a plurality of image data one after another, based on information on set image forming sizes and set paper sheet sizes for a whole of the print job, compares each image forming size with each paper sheet size and outputs the notice signal when the image forming size exceeds the paper sheet size at least in either of the lengthwise direction and the lateral direction before execution of an image forming process for each of the plurality of image data of the print job.

2. The image forming apparatus as claimed in claim 1, wherein the notice section displays a preview image of a paper sheet of the paper sheet size and an image that is to be formed onto the paper sheet of the paper sheet size.

3. The image forming apparatus as claimed in claim 1, wherein the control section again accepts inputting operations from the first operating section and the second operating section if the image forming size exceeds the paper sheet size at least in either of the lengthwise direction and the lateral direction.

4. The image forming apparatus as claimed in claim 1, wherein the control section again accepts inputting operations from the first operating section and the second operating section if the image forming size exceeds the paper sheet size at least in either of the lengthwise direction and the lateral direction, and skips an image forming process for image data as a current objective if it is denied to carry out the image forming process for the image data as the current objective in a state where the image forming size exceeds the paper sheet size and it is also denied to change information on the image forming size of the original image or the paper sheet size.

5. An image forming method that sequentially performs the following steps:

a first operation step of accepting an inputting operation for a setting on information on an image forming size of an original image;

a second operation step of accepting an inputting operation for a setting on a paper sheet size;

a control step of comparing the set image forming size with the set paper sheet size and outputting, if the image forming size exceeds the paper sheet size at least in either of a lengthwise direction and a lateral direction, a notice signal to cause a notice to that effect; and a notice step of serving the notice to a user based on the notice signal; wherein in the control step, in a case of executing a print job to carry out image forming processes for a plurality of image data one after another, based on information on set image forming sizes and set paper sheet sizes for a whole of the print job, each image forming size is compared with each paper sheet size and the notice signal is output when the image forming size exceeds the paper sheet size at least in either of the lengthwise direction and the lateral direction before execution of an image forming process for each of the plurality of image data of the print job.

6. The image forming method as claimed in claim 5, wherein, in the control step, inputting operations from the first operating section and the second operating section are accepted if the image forming size exceeds the paper sheet size at least in either of the lengthwise direction and the lateral direction, and an image forming process for image data as a current objective is skipped if it is denied to carry out the image forming process for the image data as the current objective in a state where the image forming size exceeds the paper sheet size and it is also denied to change information on the image forming size of the original image or the paper sheet size.

* * * * *